United States Patent [19]
Reim
[11] 4,348,826
[45] Sep. 14, 1982

[54] FRAME FOR PICTURES AND THE LIKE

[76] Inventor: Paul Reim, Rathausgasse 5, D 7100 Heilbronn, Fed. Rep. of Germany

[21] Appl. No.: 184,887

[22] Filed: Sep. 8, 1980

[30] Foreign Application Priority Data

Sep. 7, 1979 [AT] Austria ..... 5900/79

[51] Int. Cl.[3] ..... A47G 1/06; G09F 1/12
[52] U.S. Cl. ..... 40/155; 40/156
[58] Field of Search ..... 40/152, 152.1, 156, 40/155, 152.2, 153, 154, 157

[56] References Cited

U.S. PATENT DOCUMENTS 3,294,429 12/1966 Halip ..... 40/152
3,885,335 5/1975 Egermayer ..... 40/156
4,024,659 5/1977 Ingerdahl ..... 40/155
4,136,470 1/1979 Barz ..... 40/152
4,176,480 12/1979 Euzarraga ..... 40/156

*Primary Examiner*—Gene Mancene
*Assistant Examiner*—Michael J. Foycik
*Attorney, Agent, or Firm*—Michael J. Striker

[57] ABSTRACT

A frame for front insertion of pictures and the like has a plurality of elongated frame elements which have inclined edges and are movable relative to one another between a proximal position and a distal position, and a plurality of connecting elements each connecting a pair of the frame elements in their corner region and including an angled member insertable into each pair of the neighboring frame element so that the latter can move over the angled member between these positions, a supporting member connected to the angled member and extending inside the frame so as to support pictures and the like, and two arresting members arranged to engage with and arrest the frame elements in each of these positions.

11 Claims, 3 Drawing Figures

FRAME FOR PICTURES AND THE LIKE

BACKGROUND OF THE INVENTION

The present invention relates to a frame for pictures and the like. More particularly, to a frame for front insertion of pictures and the like, which is composed of a plurality of individual frame elements connectible with one another.

Frames of the above-mentioned general type are known in the art. A known frame has frame elements which are formed as hollow profiles with shaped legs or the like for embracing a picture or a cover plate, and corner connectors with angled members insertable into the hollow profiles and provided with holding projections engageable in recesses of the hollow profiles. Such frames in which the frame elements are manufactures of synthetic plastic profiles or metallic profiles and detachably connected by the corner connectors, are successful because they can be manufactured in cost favorable manner. In the known frames, the frame elements have only rectangular edges, and the corner connectors are formed as angled pieces which complete the corner regions of the frame and are inserted in the hollow profiles by their pin-shaped inserts. For arresting purposes, pins are provided on the inserts, the pins engageable in respective openings in the walls of the hollow profiles. The inserts reduce at their ends so that in order to release the arresting, the pins must be pressed out of the openings inwardly. Since the inserts have the conical shape, the corner connector is not guided very good in the hollow profiles. In order to attain stable connection, the angle between the inserts of the angled piece must be smaller than 90°, whereby the angled piece is located in the hollow profiles with a certain tension. This tension, on the one hand, and required bending of the inserts for releasing the arresting, make the process of exchange of pictures in the frame substantially complicated.

There are also frames in which the frame elements have inclined end edges and are connected with one another by corner connectors. The frame elements of this frame are formed as U-shaped profiles, and the corner connecting piece is swingable, screwable or rotary. When flexible profile elements are utilized, the frame elements are fixedly connected with one another in three corners of the frame and are detachably connected by the corner connecting piece only in the fourth corner. In such a frame the process of exchange of a picture is also complicated inasmuch as the frame must be dismounted. In other words, in order to exchange a picture one or more corners must be completely opened so that parts to be inserted such as a cover plate, a picture, an insert and a rear wall must be placed over one another outside of the frame and then the frame must be assembled or closed around these parts.

There are also frames in which the above mentioned parts are individually inserted from the front side and can be withdrawn at this side. In such a construction there are fixedly connected frame elements, and the parts to be inserted must be pressed over frame legs which are very accurately dimensioned, to embrace a picture or a cover plate. These frames cannot be designed with widely overlapping profiled legs and moreover they are suitable only for small dimensions, inasmuch as the cover plate or the picture during their pressing into the frame or out of the frame can be easily damaged. However, these fixed frames have the advantage that during the picture exchange all parts to be inserted can be introduced into or withdrawn from the frame one after the other, similarly to the frames changeable from the back side.

SUMMARY OF THE INVENTION

Accordingly, it is an object of the present invention to provide a frame for a picture or the like, which avoids the disadvantages of the prior art.

More particularly, it is an object of the present invention to provide a frame which is simple and inexpensive to manufacture and suitable for different shapes and dimensions.

It is another object of the present invention to provide a frame which has narrow or wide profiled legs which overlap a picture or a cover plate and in which the same can be inserted from the front side independently of the widths of the profiled leg.

Still another feature of the present invention is to provide a frame in which a picture or the like can be inserted without opening even a single corner of the frame.

Finally, a further object of the present invention is to provide a frame which allows convenient insertion of individual parts one after the other and provides for firm support of these parts preventing withdrawal or dropping out of the same.

In keeping with these objects and with others which will become apparent hereinafter, one feature of the present invention resides, briefly stated, in a frame which has a plurality of frame elements with associated inclined edges and movable between a proximal position in which the inclined edges of the neighboring frame elements abut against one another and a distal position in which they are spaced from one another, and a plurality of connecting elements each including an angled member insertable into each pair of the neighboring frame elements outside of the respective corner of the frame so that the frame elements of the pair can move relative to one another between the above-mentioned positions, a supporting member connected with the angled member and extending inside of the one corner into the inner opening of the frame so as to support a picture and the like, and two arresting members arranged to engage in and arrest the frame elements of the pair in each of the above-mentioned positions.

The frame elements are provided with shaped legs which hold a picture and the like. Each frame element is provided with a longitudinal slot arranged in the region of at least end portions and facing toward a center of the frame element or the center of the frame. The inside supporting member is connected with the outside angled member by a web extending through the longitudinal slot. The arresting members are formed as arresting projections engageable in two arresting recesses provided in the end portion of each of the frame elements.

When the frame is designed in accordance with the present invention, the connecting element with its angled member can be inserted and received in the hollow profile of the frame elements, inasmuch as in the proximal position it extends completely into the hollow profile and the arresting projections in this position engage in the respective recesses. There is provided a firm and stable assembly at the corner regions of the frame with the aid of the frame elements which can be individually and easily manufactured. In order to exchange a picture, it suffices to disengage the arresting projections and pull the frame elements from one another until the arresting projections engage in the arresting recesses corresponding to the distal position of the frame elements.

The frame elements can assume the distal position in the region of one corner or advantageously in the region of two diametrically opposite corners, if required. Thereby the frame increases its size and a picture can be inserted or withdrawn in a simple manner from the front side of the frame. The frame becomes wider in dependence on the number of the corners in which the frame elements are displaced relative to one another to their distal position. Thereby, the widths of the profile leg which embraces the parts to be inserted is not important so that the shape and construction of this profiled leg or frame practically have no limits.

Since the connecting element not only allows the exchange of the pictures without complete opening of the frame, but also has the supporting part, sagging or dropping off of the rear wall or the like is prevented when the frame is widened, and a reliable support for the parts to be inserted is provided. Thereby, by simple manipulations with the frame, the exchange of the pictures can be carried out without any difficulties.

After the exchange of a picture, including individual and successive introduction of the parts to be inserted into the frame, the frame can be brought to the final position by displacing the frame elements toward one another until their inclined edges abut against one another and the arresting projections engage in the respective recesses. The insertion of a picture in this frame is as simple as the rearward insertion of a picture in a frame which has fixedly connected inclined edges. However, in the inventive frame a picture is inserted from the front side of the frame, and the frame is manufactured by substantially cost favorable operations.

In accordance with another especially advantageous feature of the present invention, the arresting projections are arranged on springy tongues of each connecting element, the springy tongues extending substantially parallel to the legs of the angled member. The legs of the angled member can continuously match to the hollow profile so that an especially stable assembly of the frame elements is attained. Moreover, the arresting projections which are located outside of the hollow profile are easily engageable and snappable with spring action in the recesses so that a connection is obtained which is not only shape-locking but also force locking. There is a possibility that when the tongues have a certain springy action and the arresting projections have a certain form, a snap connection can be obtained which in condition of excessive pulling or pressing force allows displacement of the frame elements in longitudinal direction. In order to guarantee an operatively firm connection which cannot be unintentionally opened, the arresting projections of the frame in accordance with still another feature of the present invention, are provided with an abutment surface which acts when the frame elements are displaced from their distal position to their proximal position. The abutment surface provides for automatic release of the arresting action in the distal position by displacing the frame elements towards the proximal position. However, it forms simultaneously a kind of a barb which precludes the release of the arresting action in the proximal position. In order to disengage the arresting projections, the latter must be pressed out of the recesses which can be carried out without difficulty because of the springy characteristic of the tongues.

An especially advantageous further feature of the present invention resides in that the supporting member of the connecting elements is ring-shaped. The supporting member thereby supports not only the rear wall or the like of a picture and prevents its dropping out, but simultaneously can be used for suspending the picture. The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
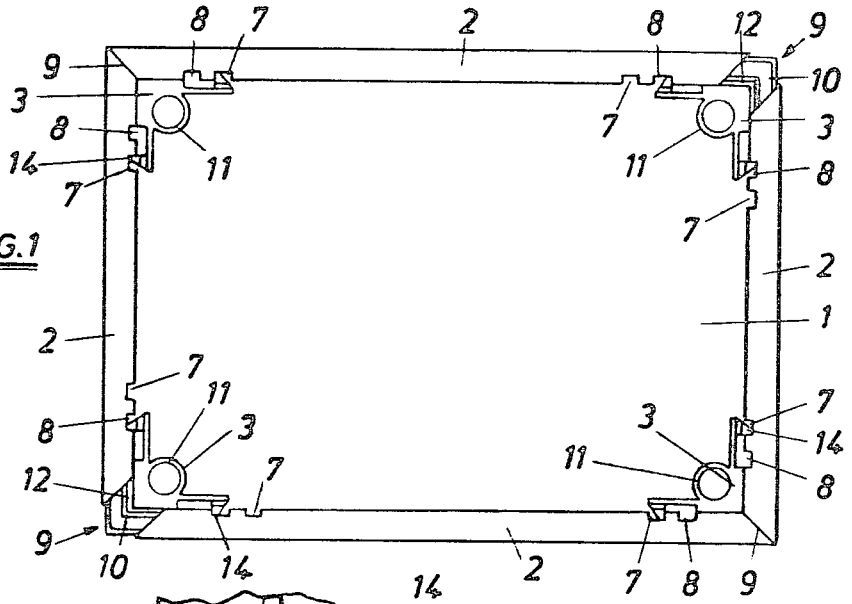
FIG. 1 is a view showing a frame in accordance with the present invention, in which inclined edges of frame elements in two corners of the frame are spaced from one another.
Figure 2:
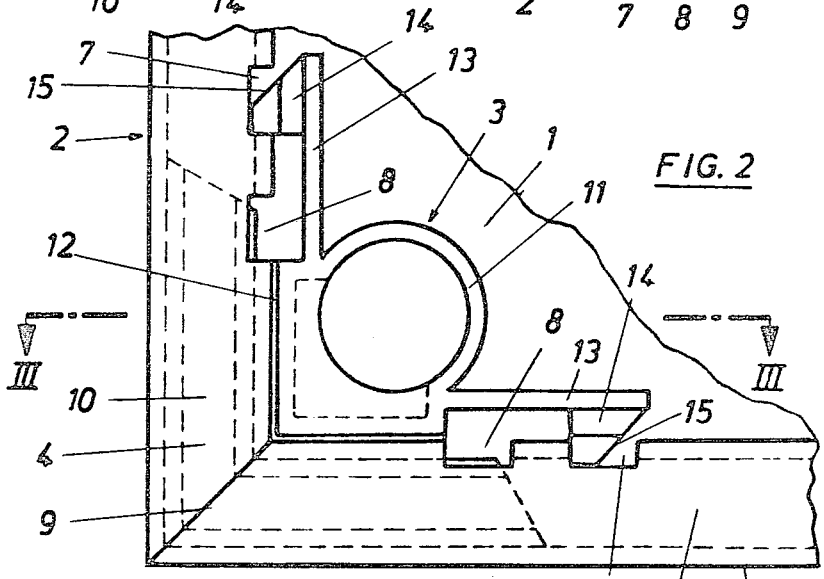
FIG. 2 is an enlarged view of one of the corners of the frame.
Figure 3:
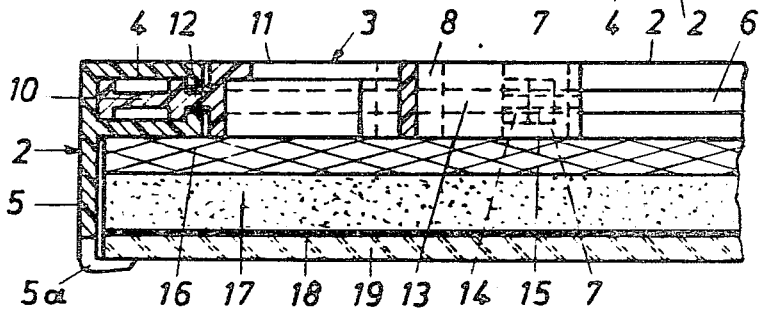
FIG. 3 is a section taken along the line III—III of FIG. 2.

A frame for a picture or the like in accordance with the present invention is identified in toto by the reference numeral 1. It is utilized for front insertion of a picture or the like and has four frame elements 2 with inclined edges.

The frame elements 2 are detachably connected with one another by corner connecting elements 3. The frame elements 2 are formed as hollow profiled members 4 of metal or synthetic plastic material. The hollow profiled members 4 are provided with profiled legs 5 for holding a picture or the like. The hollow profiled members 4 are provided with a longitudinal slot 6 which is formed in an inner wall facing toward the center of the frame. Two recesses 7 and 8 are provided in the region of each end portion of each frame element and spaced from one another in direction of elongation of the respective frame elements. The recess 7 corresponds to a distal position of the frame elements in which they are located close to one another and their inclined edges abut against one another. The recess 8 corresponds to a proximal position of the frame elements 2 in which they are spaced from one another for the purpose of insertion or withdrawal of a picture of the like.

The connecting element 3 has an angled member 10 which extends into two hollow profiles 4 abutting against one another by their inclined edges 9. The hollow profiles displace over the legs of the angled member 10 until their inclined edges directly abut against one another and the angled member 10 is completely received in them. The connecting element 3 has a supporting member 11 which extends outside of the hollow profiles 4 and inwardly of the respective corner. The supporting member 11 is connected by a web 12 with the angled member 10. The web 12 extends through the longitudinal slot 6.

Two springy tongues 13 extend from the supporting member 11 substantially parallel to the legs of the angled member 10 or to the frame elements 2. Each tongue 13 is provided with an arresting projection 14. The arresting projections 14 engage in each of the two recesses 7 and 8 of the hollow profiled member 4. Thereby, the frame elements are retained either in their distal position or in their proximal position.

In order to displace the frame elements from their proximal position to their distal position, the springy tongues 13 are bent back and the arresting projections 14 are withdrawn from the recesses 7. After this, the frame elements 2 can be moved apart from one another along the legs of the angled member. As soon as the frame elements assume their distal position, the arresting projections 14 engage in the recesses 8 and fix the frame elements. Each arresting projection 14 has an abutting face 15 which is inclined relative to the elongation of the frame elements. When the frame elements must be moved back after the insertion of a picture, it suffices to displace the frame elements toward one another, inasmuch as the arresting projections 14 with their abutting faces 15 slide out of the recesses 7 and then automatically engage in the recesses 8 in the distal position.

In order to insert a picture or the like into the frame, at least one corner of the frame must be opened. In other words, the inclined edges 9 of one pair of the frame elements are displayed away from one another, and the frame is laid by its rear side onto a support. It generally suffices to spread apart two diagonally opposite corners of the frame in order to provide a sufficient place for insertion of the picture, as can be seen in FIG. 1. The degree of widening of the frame depends upon the widths of the edge 5*a* by which the profiled leg 5 overlaps the picture or the cover plate. Because of this dependence, it can suffice to spread apart the inclined faces 9 in only one corner, or in three or four corners. However, regardless of the number of the corners in which the frame elements must be displayed away from one another, the frame always remains closed, which is attained by engagement of the arresting projections 14 in the recesses 8 in the distal position of the frame elements.

After this, a rear wall 16 can be inserted into the frame in a simple manner. In the distal position of the frame elements 2 the rear wall 16 is supported on the supporting members 18 of the connecting elements 3 and thereby secured against falling through or sagging. Thus, the connecting elements 3 provide not only for the suitable corner connection, but also form a firm support for the parts to be inserted into the frame. An arresting springy insert 17 can be inserted after the rear wall 16. Then the picture 18 and finally the cover plate 19 are inserted into the frame. After the insertion, the frame elements are displaced from their distal position to their proximal position and thus the picture is framed.

When the frame elements are displaced with respective pressure toward one another, the arresting action in their distal position is automatically terminated, and new arresting action is attained in the distal position of the frame elements. Similarly, the picture can be withdrawn from the frame in reverse order. Since the supporting members 11 are advantageously spring shaped, they can be utilized for suspending the picture or the frame 1.

The frame in accordance with the present invention can be inexpensively manufactured, is easy to manipulate, and provides for front insertion of a picture without any difficulties.

It will be understood that each of the elements described above, or two or more together, may also find a useful application in other types of constructions differing from the types described above.

While the invention has been illustrated and described as embodied in a frame for pictures and the like, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting featurs that, from the standpoint of prior art, farily constitute essential characteristics of the generic or specific aspects of this invention.

What is claimed as new and desired to be protected by Letters Patent is set forth in the appended claims.

1. A frame for front insertion of pictures and the like, comprising a plurality of elongated frame elements which together bound an inner opening having corners, each of said frame elements having two end portions spaced from one another in direction of elongation and each having an inclined edge, said frame elements being movable relative to one another between a proximal position in which the inclined edges of each pair of neighboring frame elements abut against one another and a distal position in which they are spaced from one another, each said end portion of each of said frame elements having two arresting recesses spaced from one another in direction of elongation of the respective frame element; means for holding a picture and the like in the frame and including engaging formations provided in said frame elements; and means for connecting said frame elements with one another, said connecting means comprising a plurality of connecting elements each including an angled member having two legs insertable into each pair of the neighboring frame elements outside of a respective one of said corners so that the frame elements of said pair can move over said legs relative to one another between said positions, a supporting member connected with said angled member and extending inside of said one corner into said inner opening so as to support a picture and the like, and two springy tongue members each extending in direction of elongation of the respective frame element of each pair of neighboring frame elements and each having an arresting projection alternately engageable in one of said recesses in said proximal position and in the other of said recesses in said distal position so as to retain each pair of neighboring frame elements in a respective one of said positions.

2. A frame as defined in claim 1, wherein each of said frame elements is a hollow profiled member provided with a shaped leg which forms said means for holding a picture and the like.

3. A frame as defined in claim 1, wherein each of said connecting elements includes a connecting web which connects said angled member with said supporting member.

4. A frame as defined in claim 3, wherein each of said frame elements has a longitudinal slot provided in the region of at least each of said end portions and facing toward a center of the frame, said connecting web of each of said connecting elements extending through the longitudinal slot of a respective one of said end portions of a respective one of said frame elements.